US005622112A

United States Patent [19]

Kusch et al.

[11] Patent Number: 5,622,112

[45] Date of Patent: Apr. 22, 1997

[54] WASH-UP DEVICE FOR AN INKING UNIT OF A PRINTING PRESS

[75] Inventors: Hans-Jürgen Kusch, Neckargemünd; Bernd Ruf, Weiterstadt, both of Germany

[73] Assignee: Heidelberger Druckmaschinen AG, Heidelberg, Germany

[21] Appl. No.: 495,859

[22] Filed: Jun. 28, 1995

[30] Foreign Application Priority Data

Jun. 28, 1994 [DE] Germany ..... 44 22 612.8

[51] Int. Cl.[6] ..... B41F 35/00

[52] U.S. Cl. ..... 101/423; 101/425

[58] Field of Search ..... 101/423, 425, 101/424

[56] References Cited

U.S. PATENT DOCUMENTS

| | | | |
|---|---|---|---|
| 1,201,971 | 10/1916 | Kaiser | 101/425 |
| 2,078,635 | 4/1937 | Krahmer | 101/425 |
| 2,302,490 | 11/1942 | Curtis | 101/425 |
| 2,970,541 | 2/1961 | Gegenheimer | 101/425 |
| 2,985,103 | 5/1961 | Roozee | 101/425 |
| 3,043,215 | 7/1962 | Gates | 101/425 |

FOREIGN PATENT DOCUMENTS

| | | | |
|---|---|---|---|
| 38975 | 5/1965 | Germany . | |
| 4215355 | 11/1993 | Germany . | |
| 710568 | of 1966 | Italy | 101/425 |

*Primary Examiner*—Edgar S. Burr
*Assistant Examiner*—Anthony H. Nguyen
*Attorney, Agent, or Firm*—Herbert L. Lerner; Laurence A. Greenberg

[57] ABSTRACT

Wash-up device for an inking unit of a printing press, including guide bar brackets disposable on a frame of the printing press, is provided with holders for the wash-up device insertably received in the guide bar brackets, the holders being formed by end zones of an actuating shaft for displacing the wash-up device into engagement with a roller of an inking unit to be washed; the actuating shaft, when received in an inserted position in the guide bar bracket, being turnable out of an assumed angular position thereof, for effecting engagement of the end zones of the actuating shaft behind steps formed in the guide bar brackets, so as to fix the wash-up device in an insert position, the actuating shaft being further turnable for effecting engagement by the wash-up device with the roller of the inking unit to be washed.

12 Claims, 4 Drawing Sheets

WASH-UP DEVICE FOR AN INKING UNIT OF A PRINTING PRESS

BACKGROUND OF THE INVENTION

Field of the Invention

The invention relates to a wash-up device for an inking unit of a printing press, including guide bar brackets which are disposed or disposable on a frame of the printing press and have holders of the wash-up device insertably accommodational therein.

Such a wash-up device has been disclosed heretofore in the published German Patent Document 42 15 355 A1. The wash-up device, prior to being placed in operation, is inserted in receiving slits formed in a guide bar bracket and, by means of a swivel device, is swivellable into different positions for the purpose of washing respective cylinders of a five-cylinder printing press or a satellite-type printing press. The construction of the thus disclosed, heretofore known wash-up device is quite complex.

Published Patent Document 38 975 of the former German Democratic Republic shows a wash-up device having a wash-up blade which is swivellable about a swivel axis into three positions.

SUMMARY OF THE INVENTION

It is an object of the invention to provide an improved wash-up device of the foregoing general type which is relatively easy to operate and economical to produce.

With the foregoing and other objects in view, there is provided, in accordance with the invention, a wash-up device for an inking unit of a printing press, including guide bar brackets disposable on a frame of the printing press, comprising holders for the wash-up device insertably received in the guide bar brackets, the holders being formed by end zones of an actuating shaft for displacing the wash-up device into engagement with a roller of an inking unit to be washed; the actuating shaft, when received in an inserted position in the guide bar bracket, being turnable out of an assumed angular position thereof, for effecting engagement of the end zones of the actuating shaft behind steps formed in the guide bar brackets, so as to fix the wash-up device in an insert position, the actuating shaft being further turnable for effecting engagement by the wash-up device with the roller of the inking unit to be washed.

In accordance with another feature of the invention, the end zones of the actuating shaft are formed with at least one flat at the respective peripheral surfaces thereof.

In accordance with a further feature of the invention, the guide bar brackets are formed with receiving slits for receiving the holders therein.

In accordance with an added feature of the invention, the steps formed in the guide bar brackets are formed by widenings of the receiving slits.

In accordance with an additional feature of the invention, the wash-up device includes further holders formed as holding pins which are slidingly received in holding slits formed in the guide bar brackets.

In accordance with yet another feature of the invention, the holding slits are crank-shaped.

In accordance with yet a further feature of the invention, the actuating shaft is formed with two end zones, and a respective first lever is included in vicinity of each of the end zones, the first lever, respectively, extending radially to a longitudinal extension of the actuating shaft and being secured thereto so as to be fixed against rotation relative thereto, the first lever, respectively, forming part of a respective toggle lever arrangement.

In accordance with yet an added feature of the invention, the toggle lever arrangement, respectively, includes a second lever swivellably connected to the respective first lever, the wash-up device further including a wash-up blade connected to the second levers.

In accordance with yet an additional feature of the invention, at least one of the first and second levers of each of the toggle lever arrangements is mounted so as to be displaceable in longitudinal direction thereof against a spring force for pressing the wash-up blade into engagement with the roller of the inking unit.

In accordance with another feature of the invention, the wash-up blade is resiliently pressable into engagement with the roller of the inking unit, the resilient pressing engagement by the wash-up blade being automatically readjustable for accommodating wear of the wash-up blade.

In accordance with a further feature of the invention, the wash-up device includes a respective bearing element mounted on at least one of the first and second levers of each of the toggle lever arrangements so as to be displaceable longitudinally against a spring force for pressing the wash-up blade into engagement with the roller of the inking unit.

In accordance with a concomitant feature of the invention, each of the toggle lever arrangements has a first swivel point formed by the respective end zone of the actuating shaft, and a second swivel point formed by a respective holding pin slidingly received in holding slits formed in the guide bar brackets.

Due to the foregoing construction of the inventive device, it is very simple to coordinate the wash-up device with the printing press because only the end zones of the actuating axis have to be inserted into the respective guide bar brackets. According to the invention, no additional elements are provided for fixing this insert or slid-in position to enable the wash-up blade of the wash-up device to exert a contact pressure on the roller of an inking unit to be washed; it is rather the task of the available actuating shaft, which assumes the function of effecting engagement of the wash-up blade with the roller, to ensure that, due to the turning of the actuating shaft, steps of the guide bar brackets are gripped to effect the fixing. The turning of the actuating shaft and consequent fixing of the wash-up device in an engaging position starts from the position in which the washing device has been inserted into the guide bar brackets; thus, when the actuating shaft is turned preferably manually or also automatically by means of an actuating device, initially, the wash-up device is locked or fixed in the course of the turning motion and then, when the actuating shaft is turned further, the wash-up blade is brought into engagement with the roller of an inking unit to be washed. This clearly demonstrates that, due to this dual function, the construction is very simple and inexpensive.

According to a further development, a cross-sectional view of the the wash-up device shows that the respective end zones of the actuating shaft is formed with at least one circumferential flat. The respective circumferential flat is produced, for example, by machining, e.g., a circular segment is removed from the end zone of the actuating shaft which has a circular cross section; in a particular angular position, cross-sectional tapering results. Viewed from another angular position, the full cross-section of the end zone is maintained. It is thereby possible to insert the end zones of the actuating shaft into receiving slits formed in the guide bar brackets and to grip or lock the aforementioned steps of the guide bar brackets by turning the actuating shaft. Preferably, the steps of the receiving slits are formed by enlarging or widening the receiving slits. Consequently, each receiving slit is formed with a narrow initial region followed by an enlarged or widened end region.

Preferably, the wash-up device is provided with further holding elements formed as holding pins which are slidable into the receiving slits formed in the guide bar brackets wherein they are accommodated. The receiving slits serve, on the one hand, for bracing the wash-up device, thus preventing it from turning about the end zones of the actuating shaft and, on the other hand, as guides for effecting the engagement by the wash-up blade of the wash-up device at the roller of the inking unit to be washed. Consequently, they enable the wash-up blade to be shifted as required before it is brought into engagement with the respective roller.

The receiving slits preferably have the shape of a crank. This has the advantage that, when the wash-up device is initially into the guide bar brackets, a hook-in position is attained after the first curvature of the receiving slit has been overcome, i.e., the wash-up device is thereby prevented from slipping out of the guide bar brackets. This increases the operational reliability of the device.

In particular, the actuating shaft has a first lever in the respective vicinity of each of the two end zones, the lever extending radially with respect to the longitudinal extension or direction of the actuating shaft and being mounted thereon so as to be fixed against rotation relative therewith. The respective lever forms part of a respective toggle lever arrangement. Each toggle lever arrangement includes a second lever swivellably connected to the respective first lever. The aforementioned wash-up blade is connected to both second levers either directly or indirectly.

According to a further development of the invention, at least one of the two levers of each toggle lever arrangement is mounted in longitudinal direction so as to be longitudinally displaceable against the force of a spring, and/or a bearing element is mounted on at least one of the two levers of each toggle lever arrangement so as to be longitudinally displaceable against the force of a spring for pressing the wash-up blade against the inking roller. This ensures that the wash-up blade is forced, uniformly over the length thereof, against the roller of an inking unit to be washed. As is required, the wash-up blade thus runs parallel to the roller so that the respective roller may be washed uniformly at an accurately pre-determinable high contact pressure. Moreover, this prevents premature and non-uniform wearing of the wash-up blade from wearing. The two toggle lever arrangements are disposed in the two end zones of the actuating shaft and are thus assigned to the two end zones of the wash-up blade. Notwithstanding the wear of the wash-up blade, the necessary contact pressure is always assured by means of the resilient engagement. As the wash-up blade becomes worn, it is automatically re-adjusted to maintain its engagement with the inking roller.

Finally, according to the invention, preferably one swivel location or center of rotation of each toggle lever arrangement is formed by the respective end zone of the actuating shaft and another swivel location or center of rotation of the toggle lever arrangement is formed by the respective holding pin. This results in a relatively simple construction.

Other features which are considered as characteristic for the invention are set forth in the appended claims.

Although the invention is illustrated and described herein as embodied in a wash-up device for an inking unit of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
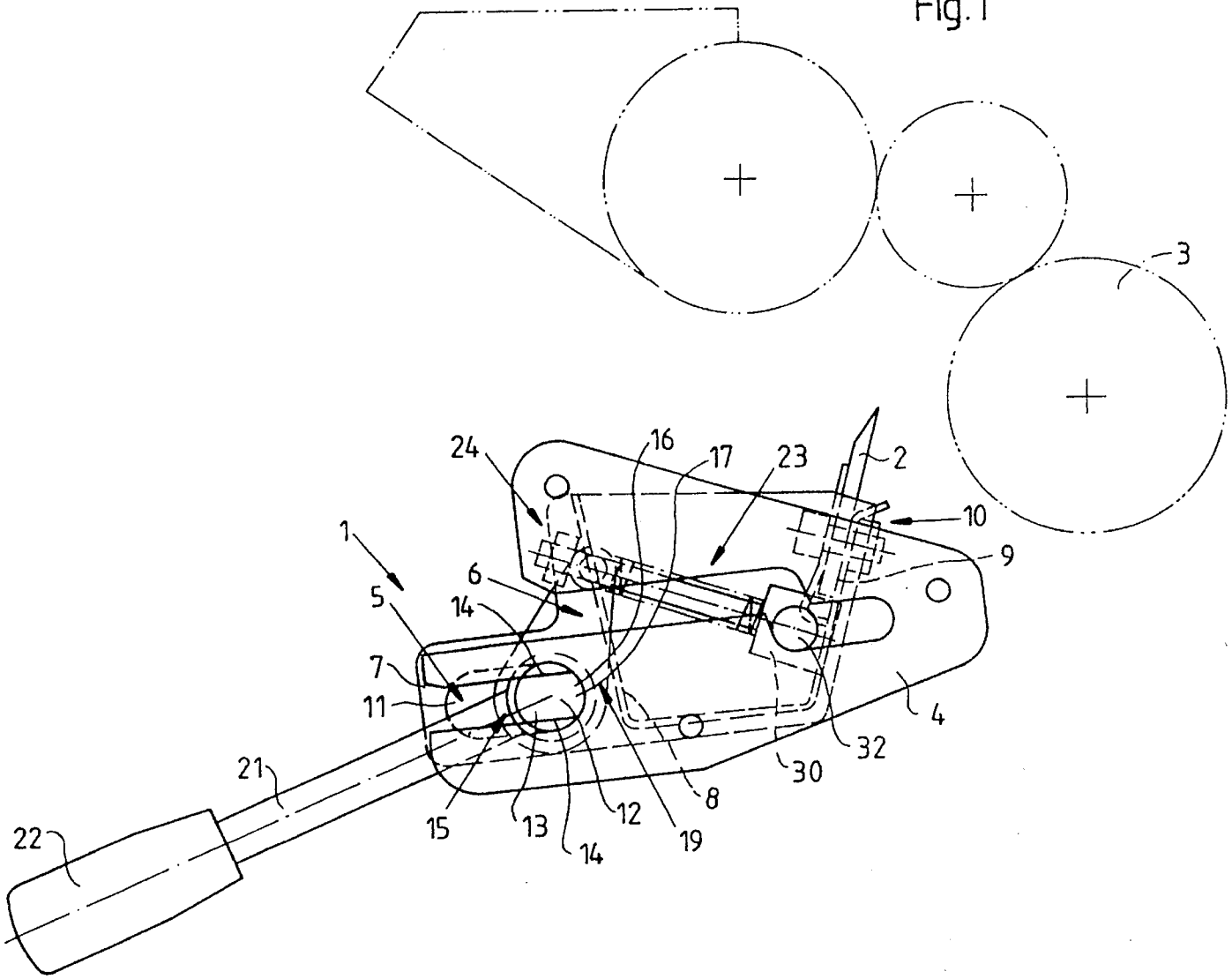
FIG. 1 is a diagrammatic side elevational view of an embodiment of the wash-up device according to the invention in an inserted position thereof in an inking unit of a printing press.

Referring now to the drawings and, first, particularly to FIGS. 1 and 7 thereof, there is shown therein a wash-up device 1 having a wash-up blade 2 which is assignable to a roller 3 of an inking unit of an otherwise non-illustrated printing press for the purpose of washing the respective roller 3.

The wash-up device 1 has, at both sides thereof, guide bar brackets 4 which are fastenable to non-illustrated side walls of the printing press. Each guide bar bracket 4 is provided with a take-up or receiving slit 5 and a holding slit 6.

Furthermore, the wash-up device 1 has side parts 7 disposed opposite one another, a trough-like container 8 being provided between the side parts 7. The wash-up blade 2 is fastened to a wall 9 of the container 8 by means of an appropriate clamping device 10, such as screw connections, for example. Slots 11 formed in the side parts 7 are penetrated by an actuating shaft 12 extending across the entire width of the wash-up device 1. End regions or zones 13 of the actuating shaft 12 which may be slid into the receiving slits 5 formed in the guide bar brackets 4 are formed with diametrically disposed circumferential or peripheral flats 14, the distance or spacing between the circumferential flats 14 corresponding to the width of a respective receiving or take-up slit 5, i.e. to the width of an initial region 15 thereof.

Figure 2:
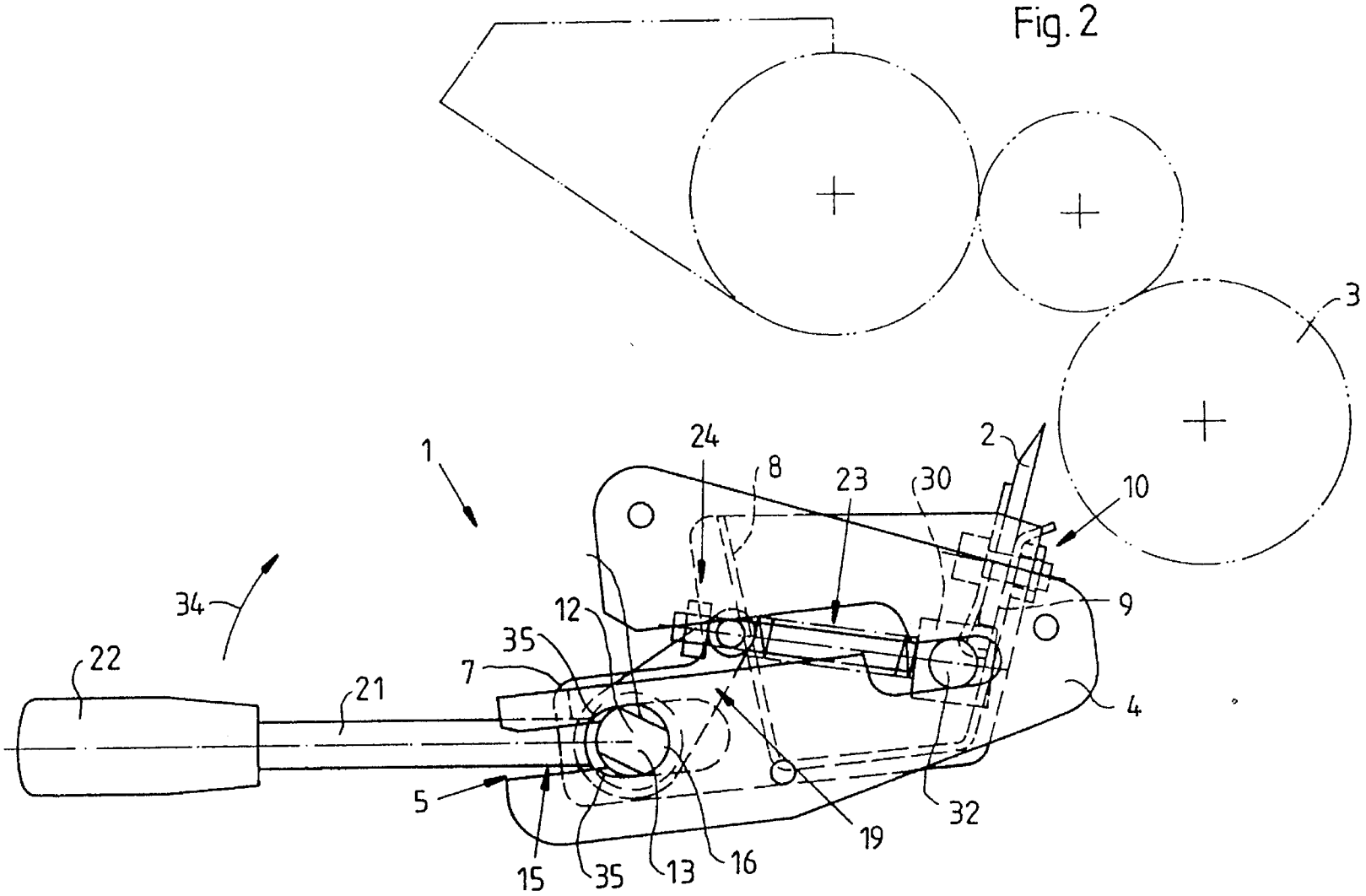
FIG. 2 is a view like that of FIG. 1 showing the wash-up device in a locked position thereof.

FIG. 2 shows in particular that the initial region 15 of the receiving slit 5 is followed by an end region 16 thereof, the end region 16 having a width greater than that of the initial region 15. The slit width of the end region 16 of each receiving slit 5 corresponds to the diameter of the end region 13 of the actuating shaft 12.

At the respective end zones 13 of the actuating shaft 12, a respective first lever 19 (FIG. 4) is fixed against rotation relative to the actuating shaft 12 and so that it extends radially with respect to the longitudinal direction of the actuating shaft 12. Both of the first levers 19 have guide sleeves or sockets 20 into which the actuating shaft 12 extends. The first levers 19 may thus, by means of radial connections, be fastened to the actuating shaft 12 so as to be fixed against rotation relative thereto.

Figure 4:
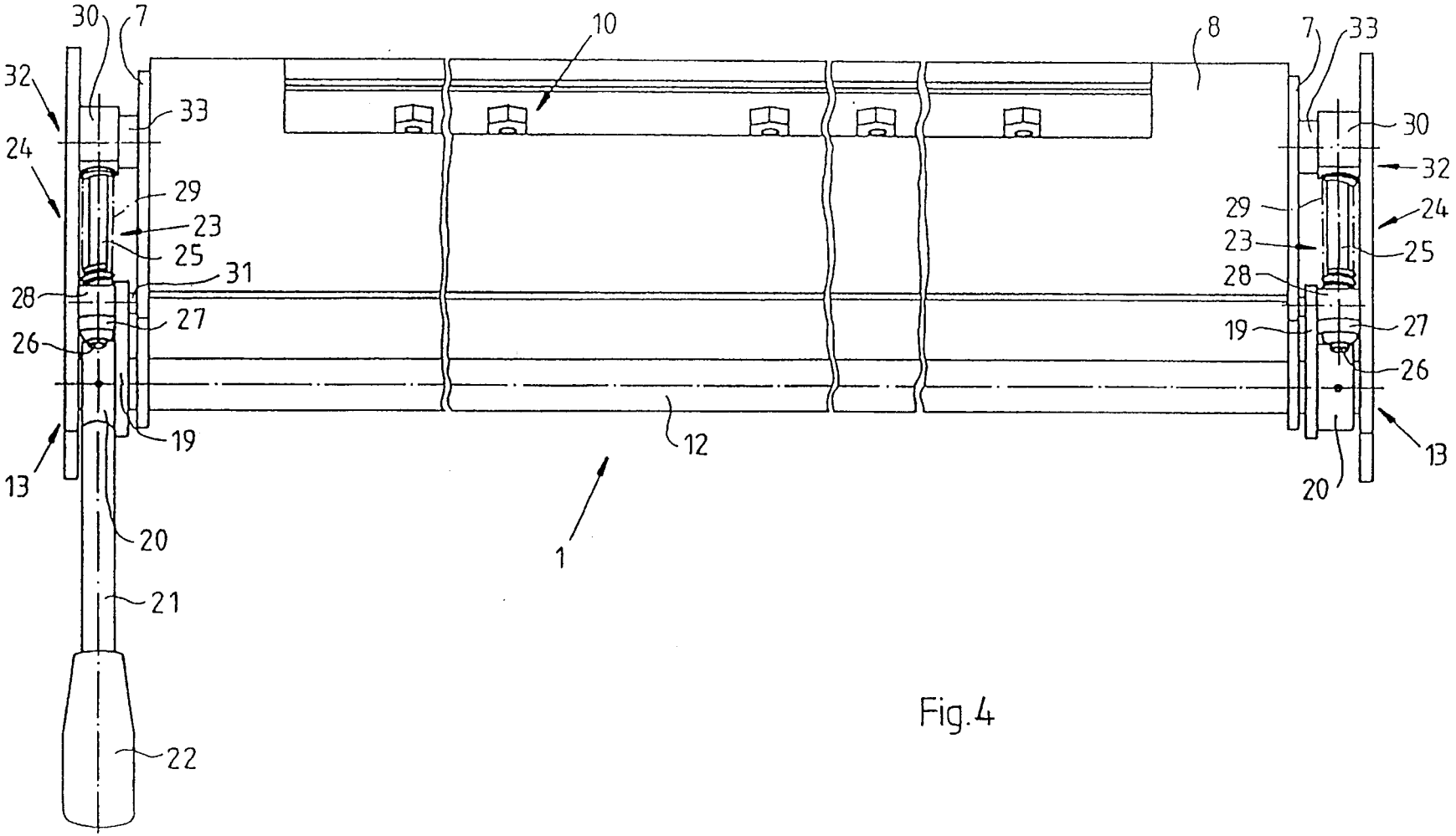
FIG. 4 is a diagrammatic top plan view of the wash-up device.

It is apparent from FIG. 4 that one of the two guide sleeves 20 is connected to an actuating arm 21 which carries a handle 22 at a free end thereof. By means of the handle 22, the wash-up device 1 is able to be actuated manually.

A second lever 23 is assigned to each first lever 19, respectively, and forms, together with the appertaining first lever 19, a toggle lever arrangement 24. Each second lever 23 is provided with a bolt 25 formed at one end thereof with a thread 26 onto which a self-locking nut 27 is screwed. An end region of the bolt 25 assigned to the self-locking nut 27 extends through a bore formed in a bearing element 28 which is acted upon by a compression spring 29 surrounding the bolt 25. One end of the compression spring 29 thus engages the bearing element 28, while the other end of the compression spring 29 is braced against a head 30 of the bolt 25. The bearing element 28 has a bearing pin or trunnion 31 extending with a slight clearance or play through a bore formed in the first lever 19. In this manner, the levers 19 and 23 of each toggle lever arrangement 24 are rotatably connected to one another.

The head 30 of the bolt 25 is formed with a holding pin 32 which is insertable into the holding slit 6. Furthermore, the head 30 is connected to the container 8 by means of a connecting piece 33.

Figure 3:
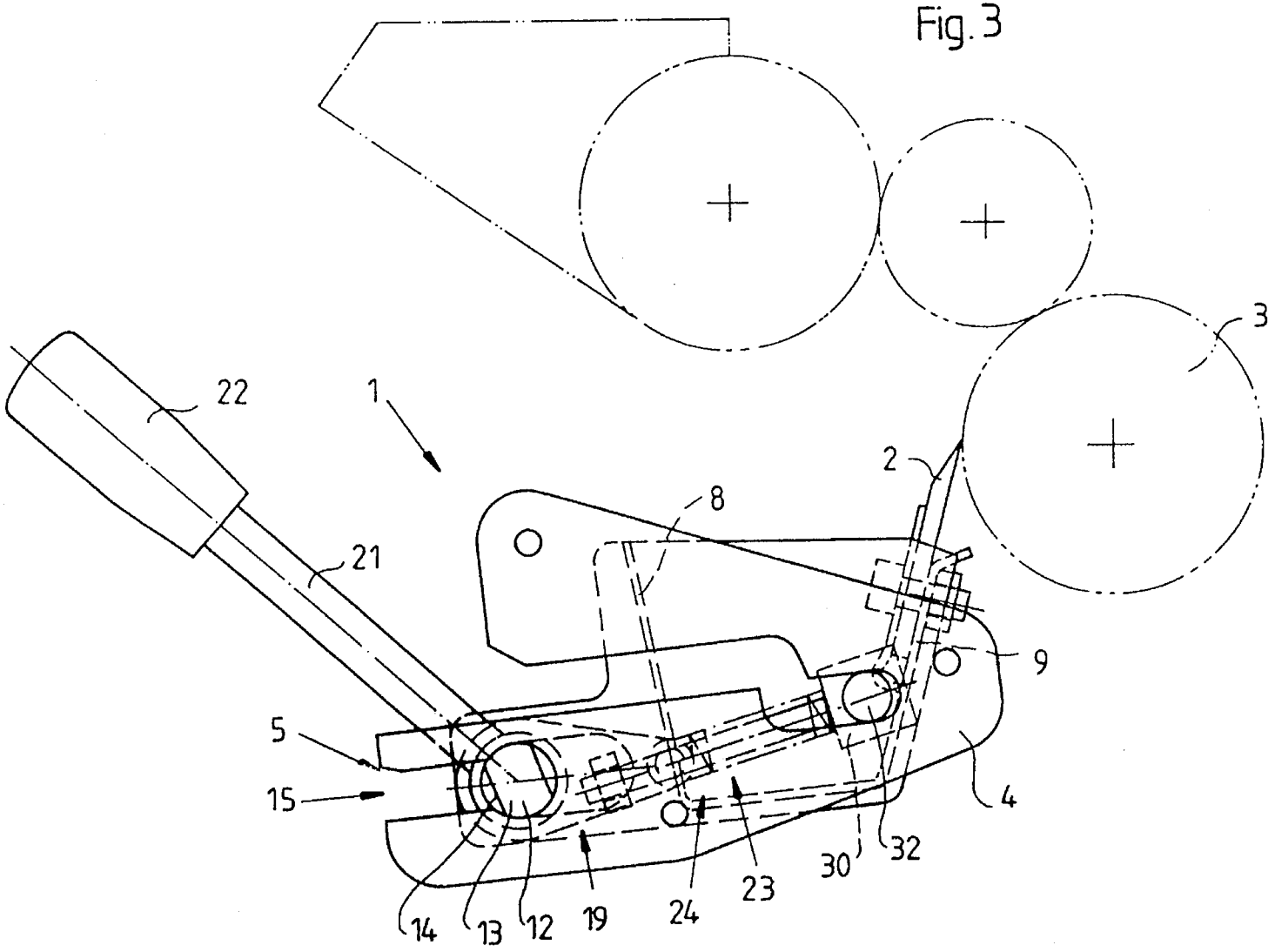
FIG. 3 is another view like that of FIG. 1 showing the wash-up device in an engaged or contact position.

The construction resulting from the foregoing components functions as follows: In order to assign to the printing press the wash-up device 1, constructed as a unit separate from the printing press, the two holding pins 32 are inserted in the respective holding slits 6 and, furthermore, while the holding pins 32 are being inserted, the end zones 13 of the actuating shaft 12 are also slid into the respective initial regions 15 of the respective receiving slits 5. In FIG. 2, the holding slits 6 are shown as having a crank-shaped construction leading to the result that the holding pins 32, while being inserted, pass through the crank-shaped sections, which consequently preventing them from sliding out of the holding slits 6. To be able to insert the end zones 13 into the initial regions 15 of the receiving slits 5, it is necessary for the actuating shaft 12 to assume a given rotary position so that the two circumferential flats 14 extend parallel to the initial regions 15 of the receiving slits 5. When the end zones 13, during the course of their insertion, enter the enlarged or widened end regions 16 of the receiving slits 5, the end zones 13 are locked in position, i.e., the end zones 13 are prevented from slipping or sliding out of the initial regions 15 of the receiving slits 5, by turning the actuating shaft 12 manually with the aid of an actuating arm 21. By moving the actuating arm 21 in the direction of the curved arrow 34 (FIG. 2) and thus turning the actuating shaft 12 in order to place the wash-up blade 2 into engagement with the roller 3 of the inking unit to be washed, the toggle lever arrangements 24 become extended, so that the holding pins 32 are displaced in the holding slits 6 towards the roller 3 and, finally, the wash-up blade 2 engages the outer cylindrical surface of the roller 3 (FIG. 3). In this position, each of the two toggle lever arrangements 24 has reached a position beyond dead center, thus automatically fixing the respective position of the wash-up blade 2. Because the wash-up blade 2 is forced by the compression springs 29, on both sides of the wash-up device 1, against the outer cylindrical surface of the roller 3, a uniform engagement is effected and a predeterminable contact pressure is applied so that very good wash-up results are afforded.

In order to disengage the wash-up device 1 from the respective roller 3, it is necessary to turn the actuating arm 21 in a direction opposite to the direction of the arrow 34, thereby leaving the respective position of each of the two toggle lever arrangements 24 beyond dead center and, finally, causing the actuating shaft 12 to assume the position thereof shown in FIG. 1. The entire arrangement is thereby able to be moved out of the slits 5 and 6 again.

Steps 35 which serve to fix the actuating shaft 12 and thereby the wash-up device 1 are formed as a result of the varying widths of the initial regions 15 and the end regions 16 of the receiving slits 5.

We claim:

1. Wash-up device for an inking unit of a printing press, comprising guide bar brackets disposable on a frame of the printing press, said guide bar brackets having receiving slits and steps formed therein, an actuating shaft for the wash-up device insertably received in said receiving slits of said guide bar brackets, said actuating shaft having end zones and effecting a displacement of the wash-up device into engagement with a roller of an inking unit to be washed; said actuating shaft, when received in an inserted position in the guide bar bracket, being turnable out of an assumed angular position thereof, for effecting engagement of said end zones of said actuating shaft behind said steps formed in said guide bar brackets, so as to fix the wash-up device in an insert position, and a toggle lever arrangement attached to said actuating shaft for effecting, in response to said actuating shaft being further turned, engagement by the wash-up device with the roller of the inking unit to be washed.

2. Wash-up device according to claim 1, wherein said end zones of said actuating shaft are formed with at least one flat at the respective peripheral surfaces thereof.

3. Wash-up device according to claim 1, wherein said steps formed in the guide bar brackets are formed by widenings of said receiving slits.

4. Wash-up device according to claim 1, including holding pins which are slidingly received in holding slits formed in the guide bar brackets.

5. Wash-up device according to claim 4, wherein said holding slits are crank-shaped.

6. Wash-up device according to claim 1, including a respective first lever in vicinity of each of said end zones, said first lever, respectively, extending radially to a longitudinal extension of said actuating shaft and being secured thereto so as to be fixed against relative rotation thereto, said first lever, respectively, forming part of said toggle lever arrangement.

7. Wash-up device according to claim 6, wherein said toggle lever arrangement, respectively, includes a second lever swivellably connected to the respective first lever, the wash-up device further including a wash-up blade connected to said second levers.

8. Wash-up device according to claim 7, wherein at least one of said first and second levers of each of said toggle lever arrangements is mounted so as to be displaceable in longitudinal direction thereof against a spring force for pressing said wash-up blade into engagement with the roller of the inking unit.

9. Wash-up device according to claim 8, wherein said wash-up blade is resiliently pressable into engagement with the roller of the inking unit, said resilient pressing engagement by said wash-up blade being automatically readjustable for accommodating wear of said wash-up blade.

10. Wash-up device according to claim 7, including a respective bearing element mounted on at least one of said first and second levers of each of said toggle lever arrangements so as to be displaceable longitudinally against a spring force for pressing said wash-up blade into engagement with the roller of the inking unit.

11. Wash-up device according to claim 10, wherein said wash-up blade is resiliently pressable into engagement with the roller of the inking unit, said resilient pressing engagement by said wash-up blade being automatically readjustable for accommodating wear of said wash-up blade.

12. Wash-up device according to claim 7, wherein each of said toggle lever arrangements has a first swivel point formed by the respective end zone of said actuating shaft, and a second swivel point formed by a respective holding pin slidingly received in holding slits formed in the guide bar brackets.

* * * * *